US005102468A

United States Patent [19]

Furrer et al.

[11] Patent Number: 5,102,468

[45] Date of Patent: Apr. 7, 1992

[54] DEVICE FOR APPLYING A DESCALING AGENT TO THE INNER SURFACE OF A HOLLOW BILLET

[75] Inventors: Hansjörg Furrer, Ziefen; Norbert Richle, Remetschwil, both of Switzerland

[73] Assignee: Lonza Ltd., Gampel/Valais, Switzerland

[21] Appl. No.: 696,996

[22] Filed: May 3, 1991

Related U.S. Application Data

[63] Continuation of Ser. No. 243,703, Sep. 13, 1988, abandoned.

[30] Foreign Application Priority Data

Sep. 29, 1987 [CH] Switzerland ..... 3777/87

[51] Int. Cl.[5] ..... B05B 1/02

[52] U.S. Cl. ..... 134/22.12; 118/317; 427/181; 427/236

[58] Field of Search ..... 134/22.12, 8, 9, 24, 134/251; 118/317; 427/181, 236

[56] References Cited

U.S. PATENT DOCUMENTS

| | | | |
|---|---|---|---|
| 679,756 | 8/1901 | Kennedy et al. | 122/395 |
| 998,762 | 7/1911 | Faller | 366/11 |
| 1,577,052 | 3/1926 | Auspitzer . | |
| 1,690,664 | 11/1928 | China . | |
| 1,944,273 | 1/1934 | Rutherford . | |
| 1,987,724 | 1/1935 | Tolman | 83/13 |
| 1,989,507 | 1/1935 | Diescher . | |
| 1,994,273 | 1/1934 | Rutherford . | |
| 2,176,879 | 10/1939 | Bartell . | |
| 2,316,571 | 4/1943 | Dunmire et al. | 80/1 |
| 2,588,625 | 3/1952 | Ferner et al. . | |
| 2,719,386 | 10/1955 | Johnson et al. . | |
| 2,735,814 | 2/1956 | Hodson, Sr. et al. . | |
| 3,198,735 | 8/1965 | Lamson et al. . | |
| 3,213,024 | 10/1965 | Blake . | |
| 3,242,075 | 3/1966 | Hunter . | |
| 3,341,454 | 9/1967 | Chor, Jr. et al. . | |
| 3,344,065 | 9/1967 | Gansheimer et al. . | |
| 3,384,581 | 5/1968 | Peace et al. | 252/219 |
| 3,472,770 | 10/1969 | Preston et al. . | |
| 3,525,692 | 8/1970 | Dodson et al. . | |
| 3,549,206 | 12/1970 | Reuter . | |
| 3,577,754 | 5/1971 | Calmes . | |
| 3,698,953 | 10/1972 | Eisenberg . | |
| 3,770,634 | 11/1973 | Dodson et al. . | |
| 3,801,504 | 4/1974 | Stone . | |
| 3,806,453 | 4/1974 | McDole | 252/22 |
| 3,833,502 | 9/1974 | Leary et al. . | |
| 3,838,048 | 8/1974 | Hedge . | |
| 3,857,202 | 12/1974 | Cavallucci | 51/411 |
| 3,908,038 | 9/1975 | Nienart et al. . | |
| 3,918,284 | 11/1975 | Reiley et al. . | |
| 3,919,158 | 11/1975 | Randell et al. | 260/30.6 |
| 3,919,518 | 11/1975 | Randell . | |
| 3,944,144 | 3/1976 | Okada et al. | 241/22 |
| 3,983,042 | 9/1976 | Jain et al. . | |
| 4,039,337 | 8/1977 | Brown et al. . | |
| 4,050,932 | 9/1977 | Lemmer . | |

(List continued on next page.)

FOREIGN PATENT DOCUMENTS

| | | |
|---|---|---|
| 295268 | 10/1969 | Australia . |
| 56-139212 | 10/1981 | Japan . |
| 58-167018 | 10/1983 | Japan . |
| 586195 | 10/1976 | U.S.S.R. . |
| 1251044 | 10/1971 | United Kingdom . |
| 2036071 | 6/1980 | United Kingdom . |

OTHER PUBLICATIONS

Chem. Abstracts, vol. 81, (1974), 109708k.

Vlasov, T. F., Stal (Steel in the USSR), (Feb. 1974), 153–154.

Meleshko, V. I., Stal (Steel in the USSR), (10), 1979, 765–769.

Chem. Abs., 102:175011F, Alkaline Battery.

Boundy and Boyer, "Styrene, its Copolymers and Derivatives," Am. Chem. Soc. Monograph Series, 1952.

*Primary Examiner*—Asok Pal

*Attorney, Agent, or Firm*—Fisher, Christen & Sabol

[57] ABSTRACT

An apparatus for applying a descaling agent to the inner surface of a red-hot hollow billet in the production of seamless tubes.

19 Claims, 1 Drawing Sheet

U.S. PATENT DOCUMENTS 4,052,323 10/1977 Feneberger et al. ..... 252/23
4,055,025 10/1977 Seese et al. .
4,055,503 10/1977 Anselment et al. .
4,090,666 5/1978 Peck ..... 239/15
4,104,178 8/1978 Jain et al. .
4,115,283 9/1978 Needham .
4,140,834 2/1979 Marcantonio et al. .
4,206,060 6/1980 Yamamoto et al. .
4,206,061 6/1980 Dodson et al. .
4,228,020 10/1980 Papay .
4,297,231 10/1981 Kahara et al. .
4,314,907 2/1982 Defretin et al. .
4,321,295 3/1982 Smith-Johannsen .
4,333,275 6/1982 Bernot .
4,339,897 7/1982 Thompson et al. .
4,351,815 9/1982 Glasstetter et al. .
4,357,249 8/1983 Mellor .
4,357,953 11/1982 Patterson .
4,452,169 6/1984 Matsuda .
4,454,172 6/1984 Koga ..... 427/235
4,454,173 6/1984 Koga ..... 427/235
4,456,539 6/1984 Shim .
4,470,939 9/1984 Schoolcraft .
4,482,275 11/1984 Shinozaki et al. .
4,490,077 12/1984 Shimada et al. .
4,535,812 8/1985 Miller .
4,575,430 3/1986 Periard et al. .
4,622,709 11/1986 Matsuda ..... 15/104.16
4,656,105 4/1987 Kobayashi et al. .
4,668,534 5/1987 Gray ..... 427/183
4,687,598 8/1987 Varma .
4,702,860 10/1987 Kinderov et al. .
4,710,307 12/1987 Periard et al. .
4,735,734 4/1988 Staub et al. ..... 232/29
4,790,263 12/1988 Eckert et al. .
4,795,495 1/1989 Dobson, Sr. ..... 134/8
4,819,471 4/1989 Cook .
4,862,838 9/1989 Hodgkins et al. ..... 123/41.35

DEVICE FOR APPLYING A DESCALING AGENT TO THE INNER SURFACE OF A HOLLOW BILLET

This application is a continuation of prior U.S. application Ser. No. 07/243,703, filing date Sept. 13, 1988, now abandoned.

BACKGROUND OF THE INVENTION

1. Field Of The Invention

The invention relates to a device for applying a descaling agent to the inner surface of a red-hot hollow billet in the production of seamless tubes as well as to a process in which the device is used.

2. Background Art

A process for descaling the inner surface of red-hot hollow billets in the production of a seamless tube and a device for carrying out such process are known (see European Published Patent Application No. 0133937). In such process and with such device, the carrier gas stream, laden with a material, namely, a descaling agent, is conducted with the swirl directly through the hollow body, namely, the red-hot hollow billet. By means of the swirl, whereby a more uniform distribution of the material in the carrier gas occurs, and of the centrifugal force occurring as a result of the swirl, a considerable part of the material is brought to the inner surface of the hollow body without following the force of gravity.

The laden carrier gas stream with the swirl must first force the static air in the hollow space through and out of it. In this case, a part of the swirl is transferred to such air and is lost for applying the material to the inner surface of the hollow body. If the laden carrier gas stream flows through the hollow space, its speed and swirl close to the inner surface are less than in the middle of the hollow space cross section. The flow becomes laminar because of the fraction on the inner surface, especially if it is scale-pitted, i.e., in the case of a hollow billet coated with a layer of scale. On the whole only a part of the swirl imparted to the laden carrier gas stream is effective in applying the material to the inner surface.

BROAD DESCRIPTION OF THE INVENTION

The object of the invention is to provide a remedy for the above-described problems associated with the above-described prior art device and process.

The invention device and process achieves the object of improving the process and especially the device of said type to bring a considerable part of the material, with which the carrier gas stream, to which the swirl was imparted, is laden, to the inner surface of the hollow body. In the invention the swirl is to be understood in the sense of a screw movement of helical line movement.

The invention includes a device for applying a descaling agent to the inner surface of a red-hot hollow billet in the production of seamless tubes, with a passage element for the carrier gas stream loaded with material, in whose passage space a swirler is placed. The swirler is designed as straight or curved guide plates placed angularly to the longitudinal axis of the device. Every portion of the straight or curved guide plates are located angularly to the longitudinal and central axis of the device. A part of the guide plates is designed as a device for feeding an additional gas to the carrier gas. That is, at least one of the guide plates provides means for the feeding of the additional gas to the carrier gas. Each feed means has an opening for the additional gas.

The feed means opening for the additional gas extends into the central portion of the passageway of the passage element.

Suitably guide plates are placed at an angle of 15° to 25° to the longitudinal axis of the device. Suitably the device for feeding additional gas is designed as a nozzle(s). Also, suitably a conically enlarged displacement body is placed in the passage device in the passage space of the passage element. Suitably, a centering device is attached on the passage element to serve as a centering means engaging the hollow billet for the centering of the passage element relative to the hollow billet.

The invention also includes a process for applying a descaling agent to the inner surface of a red-hot hollow billet, in which a carrier gas stream laden with material, after imparting of a swirl, is conducted axially through the hollow billet. The invention device is used for applying the descaling agent.

The advantages achieved by the invention are basically to be seen in the fact that laden carrier gas stream with the swirl, on penetrating into the hollow space, hits not the static air but the additional unladen gas stream that already flows through the hollow space in the same direction and with a swirl in the same direction of rotation as the laden carrier gas stream. As a result, the laden carrier stream acts directly with its entire speed and the entire swirl imparted to it for applying the material to the inner surface from one hollow space end to the other. If the additional gas stream is continued for at least part of the duration of the laden carrier gas stream, during this time the speed and swirl loss, caused by the friction of the laden carrier gas stream on the inner surface, is offset by the action of the additional gas stream, so that, as a whole, a swirl is produced that is equal to the swirl imparted to the carrier gas stream depending on the speed and swirl of the additional gas stream, but also can be greater (or also smaller) than it. As a whole the effectiveness of the known process or the known device is considerably improved by the invention. Further advantages and advantageous embodiments of the invention come out below from the following description of a way of embodiment of the invention.

Preferably, air is used as the carrier gas and as the additional gas. The descaling agent can be present in the form of powder or granules.

All known compositions can be used as the descaling agent, but preferably those are used which are disclosed in European Published Patent Application No. 0169413.

The gas stream leaving the hollow billet containing the carrier gas and the additional gas as well as a residue of the material can be exhausted, to support the flow in the hollow billet, by customary devices, and the residue of the material, if it consists of fine particles, can be collected in a separator for another use or recirculation.

BRIEF DESCRIPTION OF THE DRAWING

The invention is explained in greater detail below by a drawing representing only one way of embodiment. In the drawing:

The FIGURE shows a perspective view of a partially sectioned device for carrying out the process for applying a descaling agent to the inner surface of a hollow billet, whose hollow space is largely cylindrical.

DETAILED DESCRIPTION OF THE INVENTION

Figure 1:
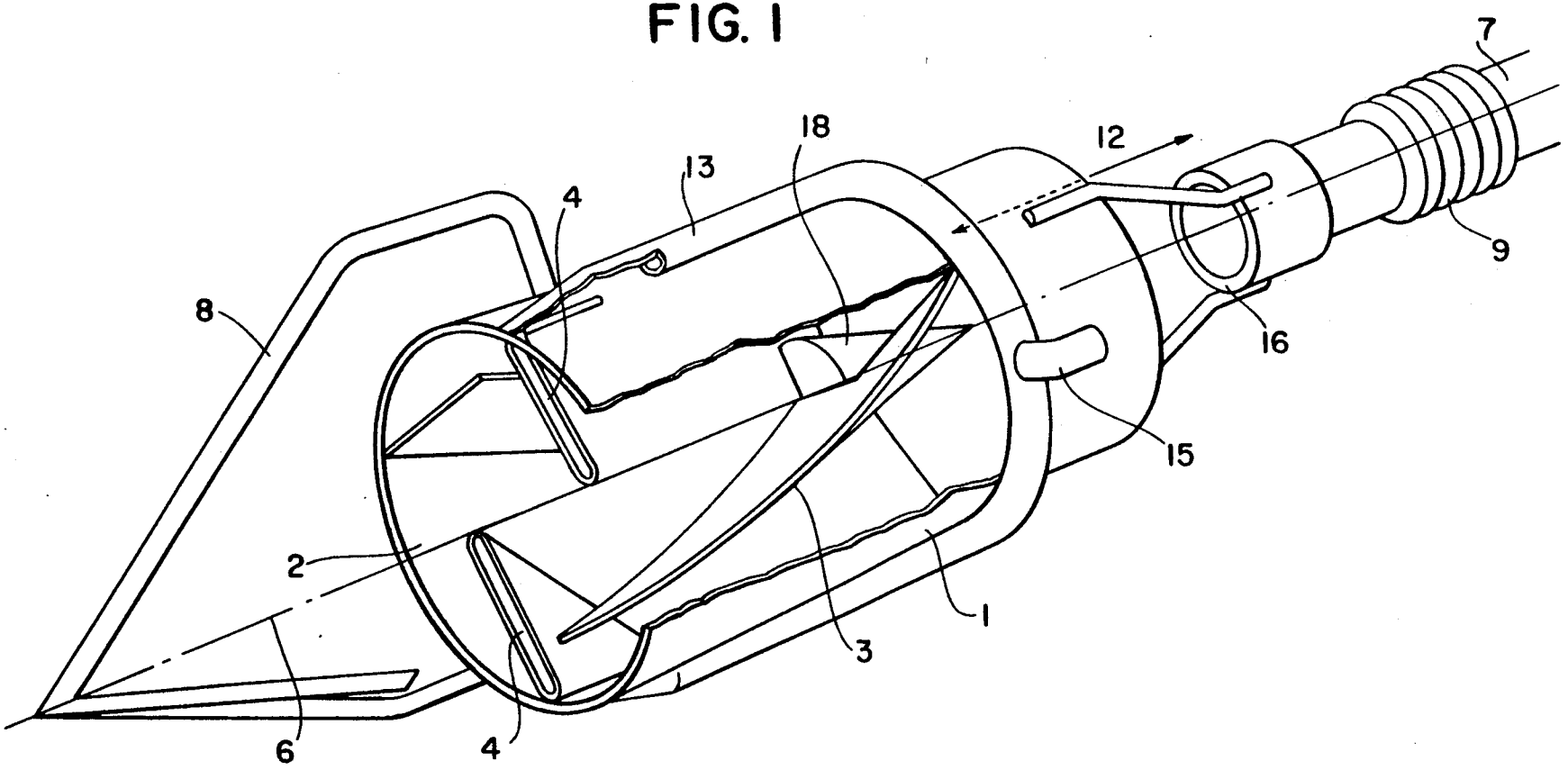

In connection with the invention the essential part is passage element 1 for a carrier gas stream laden with the material. Passage element 1 can be designed as a cylinder or as a passage with square or rectangular cross section, for example. The cylinder form is advantageously used. Guide plates 3 are placed in passage space 2 of passage element 1 and form a swirler for the laden carrier gas stream. According to the invention a part of guide plates 3 is designed as feed device 4, in the FIGURE as nozzles 4, for an additional gas which is not laden with material. Their exhaust directions are equiangular to guide plates 3, relative to longitudinal axis 6 of the device (which should also be the central axis of the hollow billet). Thus, a swirl can be imparted to the gas. The direction of rotation is, thus, insignificant for the effect of the application.

Between the end of mouthpiece 16 of feedpipe 7 and the beginning of displacement body 18, there is on the periphery an open intermediate space 12 of, e.g., 15 to 35 mm, preferably 20 mm in length, by which with jet apparatus (jet pumps, atomizers) the known effect is achieved which leads to a better distribution of the material in the carrier gas stream leaving the passage element. If entry of air to the laden carrier gas stream is not desired, an outwardly closed annular space with the gas feed surrounding the intermediate space can be provided. Pipes 13, which are provided for the feeding of the additional gas by means of connection 15, run along passage element 1 to nozzles 4.

Conically enlarged displacement body 18 is placed in passage space 2 in the flow direction. To achieve an advantageous effect, the angle of cone 18, measured on axis 6, is suitably selected to be between 20° and 50°. The angle is preferably 40°.

Guide plates 3 are straight or slightly curved, at an angle, measured on the guide plate end, of 15° to 25° to axis 6, preferably of 20° to axis 6.

Nozzles 4 also have the function of guide plates 3, that is, part of guide plates 3 are designed as nozzles 4. Their angle to axis 6 consequently corresponds to that of guide plates 3. Three to six guide plates 3, preferably four guide plates 3, are placed in passage element 1. Two or three of these guide plates 3, preferably two of guide plates 3, are designed as nozzles 4. Advantageously nozzles 4, viewed from the cross section of passage element 1, are placed opposite one another.

The device according to the invention is suitably used for amounts of 100 to 1000 g of descaling agent.

Passage elements 1 as well as their components can be varied in size to match hollow billets of different diameters.

With the device according to the invention, the inner surface of red-hot hollow billets for the production of seamless tubes, 4 to 12 meters long with an inside diameter of 10 to 40 cm, are advantageously descaled.

As a rule the procedure is that the device is brought up to the hollow billet by a sliding device with the help of centering device 8, which engages the hollow billet, and spring device 9.

Then air, not laden with the descaling agent, is blown into the hollow billets through nozzles 4 with a pressure suitably of 2 to 6 bars. Thus, two axially staggered helical line-shaped streams of this air are produced in the hollow space. Simultaneously or immediately afterward the air stream laden with descaling agent starts up. A swirl is correspondingly imparted to the air stream in passage element 1 by means of guide plates 3. The pressure of the laden air stream also suitably varies between 2 and 6 bars.

After the amount of air laden with descaling agent has gone through the hollow billet, the gas feed is interrupted, the sliding unit is retracted and the system is ready to descale the next hollow billet.

What is claimed is:

1. Device for applying a descaling agent to the inner surface of a red-hot hollow billet in the production of a seamless tube, having a passage element (1) for the carrier gas stream loaded with a solid descaling agent, a swirler located in the passageway (2) of the passage element (1), characterized in that the swirler has the straight or curved guide plates (3) every portion of which are located angularly to the longitudinal or central axis (6) of the device, at least one of the guide plates (3) provides means (4) for the feeding of an additional gas to the carrier gas, and each feed means (4) has an opening for the additional gas, the opening extending into the central portion of passageway (2).

2. Device according to claim 1 wherein the guide plates (3) are placed at an angle of 15° to 25° to the axis (6) of the hollow billet.

3. Device according to claim 2 wherein means (4) for feeding the additional gas is a nozzle or nozzles.

4. Device according to claim 3 wherein a conically enlarged displacement body (18) is placed in the passage device in the passage space (2) of the passage element (1) so that the apex of the conical body (18) points into the flow of the carrier gas stream.

5. Device according to claim 4 wherein a centering device (8) is attached on the passage element (1) to serve as a centering means engaging the hollow billet for the centering of the passage element (1) relative to the hollow billet.

6. Device according to claim 1 wherein means (4) for feeding the additional gas is a nozzle or nozzles.

7. Device according to claim 1 wherein a conically enlarged displacement body (18) is placed in the passage device in the passage space (2) of the passage element (1).

8. Device according to claim 1 wherein a conically enlarged displacement body (18) is placed in the passage device in the passage space (2) of the passage element (1) so that the apex of the conical body (8) points into the flow of the carrier gas stream.

9. Process comprising applying a descaling agent to the inner surface of a red-hot hollow billet in the production of seamless tubes a carrier gas stream laden with material, after imparting of a swirl, being conducted axially through the hollow billet, a device being used for applying the descaling agent, the device having a passage element (1) for the carrier gas stream loaded with a solid descaling agent, a swirler located in passage element (2) of the passage element (1), the swirler being straight or curved guide plates (3) every portion of which are located angularly to the longitudinal axis (6) of the device, at least one of guide plates (3) providing the means (4) for feeding an additional gas to the carrier gas, and each feed means (4) has an opening for the additional gas, the opening extending into the central portion of passageway (2).

10. Process according to claim 9 wherein the guide plates (3) are placed at an angle of 15° to 25° to the axis (6) of the hollow billet.

11. Process according to claim 9 wherein means (4) for feeding the additional gas is nozzle or nozzles.

12. Process according to claim 9 wherein a conically enlarged displacement body (18) is placed in the passage device in the passage space (2) of the passage element (1) so that the apex of the conical body (8) points into the flow of the carrier gas stream.

13. Process according to claim 9 wherein a centering device (8) is attached on the passage element (1) to serve as a centering means engaging the hollow billet for the centering of the passage element (1) relative to the hollow billet.

14. Device according to claim 3 wherein the exhaust directions of the nozzle of means (4) for feeding the additional gas to the carrier gas is equiangular to the guide plate (3), relative to the longitudinal axis of the device.

15. Device according to claim 3 wherein there are three to six guide plates (3) and two or three of the guide plates have nozzle means for feeding the additional gas.

16. Device according to claim 4 wherein the angle of cone (18), measured on longitudinal axis (6), is between 20 and 50 degrees.

17. Process according to claim 11 wherein the exhaust directions of the nozzle of means (4) for feeding the additional gas to the carrier gas is equiangular to the guide plate (3), relative to the longitudinal axis of the device.

18. Process according to claim 11 wherein there are three to six guide plates (3) and two or three of the guide plates have nozzle means for feeding the additional gas.

19. Process according to claim 12 wherein the angle of cone (18), measured on longitudinal axis (6), is between 20 and 50 degrees.

* * * * *